US005790927A

United States Patent [19]

Ando et al.

[11] Patent Number: 5,790,927

[45] Date of Patent: Aug. 4, 1998

[54] CHARGING MEMBER AND PROCESS CARTRIDGE HAVING SAME

[75] Inventors: Atsutoshi Ando, Kashiwa; Junichi Kato, Toride; Satoru Inami, Kashiwa; Jun Suzuki, Numazu, all of Japan

[73] Assignee: Canon Kabushiki Kaisha, Tokyo, Japan

[21] Appl. No.: 707,719

[22] Filed: Sep. 4, 1996

[30] Foreign Application Priority Data

Sep. 5, 1995 [JP] Japan ..... 7-228086

[51] Int. Cl.[6] ..... G03G 15/02

[52] U.S. Cl. ..... 399/176; 399/174

[58] Field of Search ..... 399/168, 174, 399/175, 176

[56] References Cited

U.S. PATENT DOCUMENTS

| | | | |
|---|---|---|---|
| 3,778,690 | 12/1973 | Rothacker et al. | 317/262 |
| 4,309,737 | 1/1982 | Tolmie, Jr. | 399/176 X |
| 5,384,626 | 1/1995 | Kugoh et al. | 399/176 |
| 5,440,374 | 8/1995 | Kisu | 399/176 |
| 5,459,558 | 10/1995 | Ishiyama | 399/176 |
| 5,475,471 | 12/1995 | Kisu et al. . | |
| 5,483,323 | 1/1996 | Matsuda et al. | 399/175 |
| 5,543,899 | 8/1996 | Inami et al. . | |
| 5,576,805 | 11/1996 | Ishihara et al. | 399/176 |

FOREIGN PATENT DOCUMENTS

| | | |
|---|---|---|
| 0328113 | 8/1989 | European Pat. Off. . |
| 0458273 | 11/1991 | European Pat. Off. . |
| 0541375 | 5/1993 | European Pat. Off. . |
| WO91/10942 | 7/1991 | WIPO . |

*Primary Examiner*—Sandra L. Brase

*Attorney, Agent, or Firm*—Fitzpatrick, Cella, Harper & Scinto

[57] ABSTRACT

A charging member contactable to a member to be charged and capable of being supplied with a voltage to charge the member to be charged, the charging member including a core member having a stepped portion to provide a smaller diameter portion at an end portion side than at a longitudinally central side; and an elastic member supported by the core member, the elastic member covering the stepped portion.

17 Claims, 10 Drawing Sheets

CHARGING MEMBER AND PROCESS CARTRIDGE HAVING SAME

FIELD OF THE INVENTION

The present invention relates to a charging member for charging a chargeable member such as a photosensitive member and or a dielectric member, more specifically, a charging member employed in an image forming apparatus such as a copying machine or a printer, and to a process cartridge comprising such a charging member.

DESCRIPTION OF THE RELATED ART

Referring first to FIG. 7, the charging apparatus of a conventional image forming apparatus will be described in detail.

In the case of a contact type charging apparatus, a charging member 2 to which voltage is applied is placed in contact with a photosensitive drum 1 to directly transfer electric charge to the photosensitive drum 1, so that the surface of the photosensitive drum 1 is charged to a predetermined potential. Therefore, the contact type charging apparatus is advantageous in that it is possible to reduce the voltage necessary to give the surface of the photosensitive drum 1 a predetermined potential; only an extremely small amount of ozone is generated during the charging process; and the structure is simple. Consequently, it has been attracting attention as a replacement for the corona discharge type apparatus as the means for charging an image bearing member such as the photosensitive drum 1, as well as a photosensitive member or a dielectric member, and has been put to practical use.

Regarding this contact type charging system or an apparatus employing such a system, there is a system in which in order to uniformly charge the photosensitive drum 1, an oscillating voltage composed by superposing a DC voltage on an AC voltage is applied to a contact type charging member 2 while the contact type charging member 2 is placed in contact with the photosensitive drum 1.

The charge roller 2, that is, the charging member of the contact type charging apparatus, will be described in detail. For example, referring to FIG. 7, the charge roller 2 comprises a metallic core 21, an elastic layer 22 composed of electrically conductive rubber or the like, and a surface layer 23 as an electrically resistive layer. The elastic layer 22 is laid on the metallic core 1, and the surface layer 23 is laid on the elastic layer 22. The charge roller 2 is supported by bearings 24 which are under pressure from a spring 26, whereby the charge roller 2 is kept in contact with the photosensitive drum 1, with a predetermined contact pressure applied through the bearings 24 by the spring 26. In some cases, one or both of the bearings 24 are formed of electrically conductive material to establish electrical connection from a power source 27.

In the case of an image forming apparatus capable of handling a transfer medium of an extremely large size, the metallic core of the charge roller 2 is extremely long (in the axial direction). Therefore, in order to provide the charge roller 2 with a certain degree of rigidity, it is necessary to increase the diameter of the metallic core, compared to the shorter metallic core. In recent years, on the other hand, a different type of charge roller has been put to use in some cases, which has a stepped longitudinal section, that is, having a relatively larger diameter across the longitudinal center portion, and a relatively smaller diameter at both ends at which the roller is supported by the bearing. This is due to the fact that recently, demands for downsizing the image forming apparatus have been increasing, and also, the provision of the metallic core exchangeability between the image forming apparatuses for a small size transfer medium and the image forming apparatus for a large size transfer medium offers merits in cost reduction.

Next, referring to FIG. 8, a method for producing the charge roller 2 will be described. First, the metallic core 21 of the charge roller 2 is set in a charge roller production mold 31, and a material such as electrically conductive rubber for covering the metallic core 21 is injected into the mold 31 to form a roller. During this process, an end mold 32 which prevents the material from leaking out of the end portions of the main mold is set at both ends to form the end configuration. The internal contour of the end mold 32 is such that it exactly matches the combined configuration of the end portions of the charge roller 2 and the metallic core 21.

However, in the case of the charge roller 2 with the provision of stepped portions in the longitudinal direction thereof, the internal contour of the end mold 32 has to be also given the stepped portion during the process of producing the end mold 32 for the charge roller 2, so that it faithfully matches the end configuration of the charge roller 2. As the number of the stepped portions increases, it becomes rather difficult to produce the end mold with high accuracy. As a result, the production cost of the end mold 32 substantially increases in comparison with that for the metallic core 21 without the stepped portions.

Further, the elastic layer of the conventional charger roller does not have strong enough adhesive force to stay on the supporting member against the pressure applied in the longitudinal direction of the charge roller. Therefore, when pressure is applied to the elastic layer as the charge roller 2 is rotated, the elastic layer is liable to be displaced in the longitudinal direction of the roller 2. The charge roller 2 whose elastic layer has been displaced in the longitudinal direction causes image defects, since the displacement of the elastic layer allows the shaved portion of the photosensitive drum surface to be involved in image formation. The shaving of the photosensitive drum surface occurs more prevalently in the area corresponding to the end portions of the charge roller 2 than in the area corresponding to the other portions of the charger roller 2. The cause of this phenomenon will be described in detail with reference to FIGS. 9, 10 and 11.

Referring to FIG. 9, the end portion of the charge roller 2 tends to rise above the other portions of the charge roller 2 because of the sagging of the surface coat, or the processing of the end portion of the underlayer, which is liable to create a deformed portion 41 such as a recessed portion. Referring to FIG. 10, as the charge roller 2 having the external configuration described above is pressed upon the photosensitive drum 1, an air gap 42 is created. If this air gap 42 between the charge roller 2 and the photosensitive drum 1 grows larger than a certain size due to the deformation or the like of the end portion of the charge roller 2, electric discharge, which occurs in the air gap 42 during the charging process, increases relative to the electric discharge which occurs when the air gap 42 is smaller. In the region in which such a phenomenon is occurring, the attack on the photosensitive drum 1 becomes more intensive. Consequently, the surface shaving of the photosensitive drum 1 occurs more in this region than in other regions.

Referring to FIG. 11, in some of the conventional charge rollers, the longitudinal end surface is not covered with the surface layer 2 as the resistive layer. In the case of such a charge roller, when voltage is applied by the bias power source 27, electric discharge is liable to occur from the longitudinal end surface. This means that the longitudinal end portion of the charge roller 2 has a larger electric discharge area, being more liable to shave the photosensitive drum surface, than the other areas. Further, even if the distance from the photosensitive drum 1, is close, there still is a possibility that electric discharge occurs from the metallic core 21 to the photosensitive drum 1. Also, even when this distance is increased by providing the corresponding bearing portion of the metallic core 21 with the stepped portion, it is still impossible to suppress the electric discharge from the upright surface of the stepped portion.

When the surface layer of the photosensitive drum 1 is substantially shaved, image defects occur. More specifically, the sensitivity of the photosensitive drum 1 is reduced in the shaved area of the photosensitive drum 1. As a result, the potential corresponding to the white portion of a target image does not sufficiently drop during the reversal development process, causing a fogging phenomenon, that is, the portion of the printed image, which should be printed white, is printed black. When this phenomenon occurs, dark vertical stripes or the like appear in the print. As long as the above phenomenon occurs outside the image formation region of the image forming apparatus, there is no serious problem in terms of the final image. However, in recent years, demands for a smaller image forming apparatus have been increasing, and an image forming apparatus having an extremely short dimension in the longitudinal direction is preferred. Therefore, there is no dimensional latitude for designing the image forming apparatus in such a manner that the region associated with the image defects can be kept sufficiently out of the image forming region. Consequently, as described above, when the elastic layer 22 of the charge roller 2 is displaced in the longitudinal direction even by the slightest distance, the image defect causing region is placed in the image forming region, causing image defects in the finished print.

Further, even when the fog corresponding region does not enter the image forming region, the excessive toner 7 on the fog corresponding region is simply removed, and accumulated into a waste toner container 18, by a cleaning apparatus 11. As a result, the capacity of the waste toner container 18 is sometimes exceeded by the amount of the accumulated waste toner, allowing the waste toner to spill over the edges of the waste toner container 18, and to scatter in the image forming apparatus. Further, when the waste toner scatters in the image forming apparatus, the scattering waste toner is liable to adhere to the transfer medium 12, which may result in a soiled image.

Also, the shaved surface of the photosensitive drum 1 is inferior in surface condition; it has a larger coefficient of friction. Therefore, the friction, which occurs between a cleaning blade 10 and the photosensitive drum 1 when the toner 7 remaining on the surface of the photosensitive drum 1 after the image transfer process is scraped off by the cleaning blade 10, sometimes becomes too large for the cleaning blade 10 to withstand, causing the cleaning blade 10 to bend backward and buckle. As the cleaning blade 10 buckles backward, the image forming apparatus loses its capacity for cleaning the photosensitive drum 1, and can no longer form a normal image, becoming useless.

SUMMARY OF THE INVENTION

Accordingly, a primary object of the present invention is to provide a charging member which has higher rigidity in the longitudinal direction thereof, and the core member and the elastic layer of which are prevented from becoming displaced from each other in the longitudinal direction thereof, and also, to provide a process cartridge comprising such a charging member.

Another object of the present invention is to provide a charging member and a process cartridge having a structure simple enough to afford cost reduction.

Another object of the present invention is to provide a process cartridge capable of preventing the image defect causing region, which is created on the surface of an image bearing member as the surface layer of the image bearing member is shaved, from entering the image forming region, so that the production of an image tainted with linear defects can be prevented.

Another object of the present invention is to provide a charging apparatus and a process cartridge capable of preventing a member to be charged, from being shaved at the end portions thereof, and also capable of preventing the cleaning blade from becoming buckled backward.

Another object of the present invention is to provide a charging apparatus and a process cartridge capable of preventing electric current from leaking from the longitudinal end thereof in the longitudinal direction of the core member.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the preferable embodiments of the present invention will be described with reference to the drawings.

Figure 17:
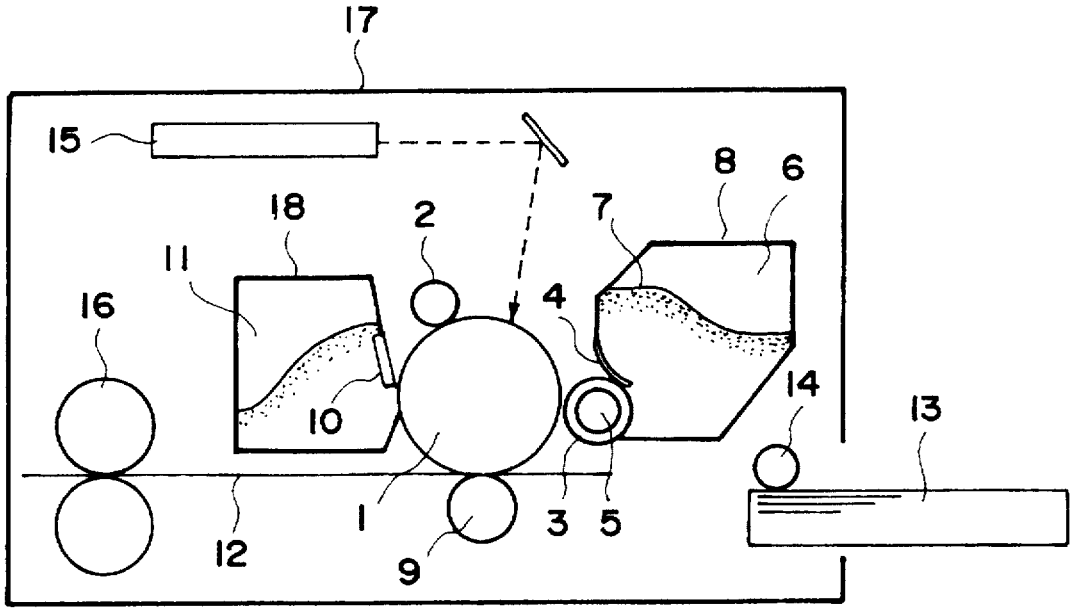
FIG. 17 is a schematic section of an image forming apparatus.

FIG. 17 is a schematic section of an example of an image forming apparatus compatible with the charging apparatus and the process cartridge in accordance with the present invention.

In the drawing, a reference numeral 17 designates the main assembly of an image forming apparatus. A reference numeral 1 designates a cylindrical photosensitive drum as a member to be charged, on which a latent image is borne. It rotates in one direction about its axis. After the surface of the photosensitive drum 1 is uniformly charged by a charging apparatus 2, a latent image is formed on the surface by an exposing apparatus 15. A developing apparatus 6 comprises a hopper which stores toner 7, and a development sleeve 3 on which developer is carried, and supplies the toner 7 to the latent image formed on the photosensitive drum 1, visualizing the latent image. Adjacent to the development sleeve 3, a development blade 4 which is a member for regulating the developer is disposed. Between the photosensitive drum 1 and the development sleeve 3, a power supply (unillustrated) is connected to apply an appropriate development bias composed by superposing an AC bias on a DC bias.

The image on the photosensitive drum 1 visualized by the toner 7 is transferred onto a transfer medium 12 by a transferring apparatus 9. The transfer medium 12 is fed by a sheet feeder roller 14, and is delivered to the transferring apparatus 9 in synchronism with the image on the photosensitive drum 1, by a registration roller (unillustrated). The image visualized by the toner 7 and transferred onto the transfer medium 12 is further conveyed, together with the transfer medium 12, to a fixing apparatus. In the fixing apparatus 16, the toner image is fixed to the transfer medium 12 with heat and/or pressure, becoming a permanent image. On the other hand, the developer which is not transferred and remains on the photosensitive drum 1 after the image transfer is removed by a cleaning apparatus 11 comprising a cleaning blade 10, and is accumulated in a waste toner container 18. Thereafter, the surface of the photosensitive drum 1 is charged again by the charging apparatus 2 to be subjected to the aforementioned process.

Embodiment 1

Figure 1:
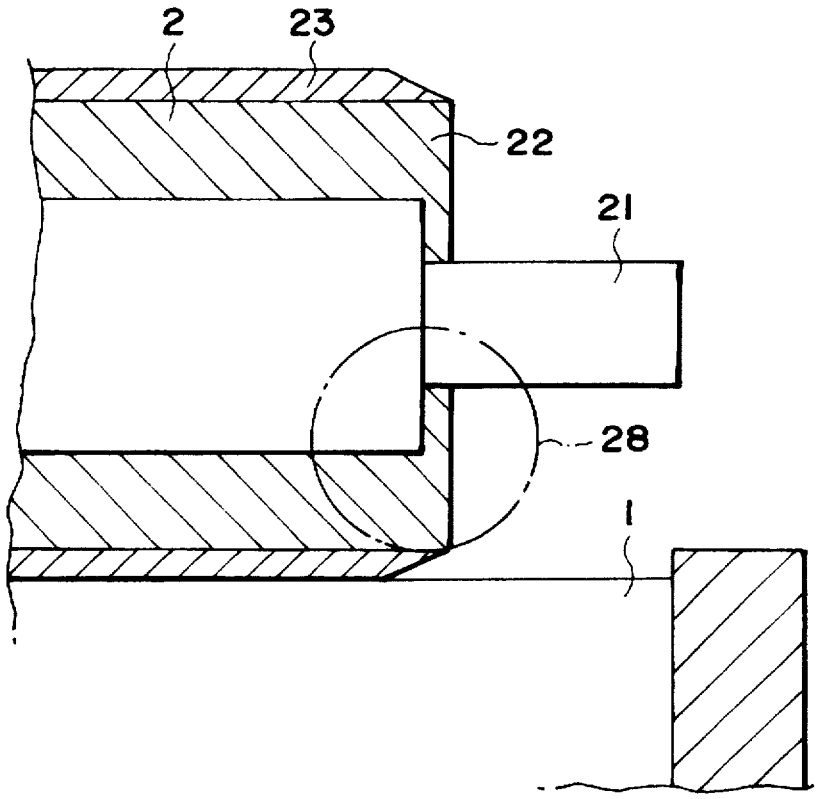
FIG. 1 is a sectional view of the charging member in the first embodiment of the present invention, as seen from the lateral side thereof relative to the longitudinal direction.

FIG. 1 is a longitudinal section of the end portion of the charge roller as the charging member in an embodiment of the present invention.

In this embodiment, the stepped portion of the metallic core of the charging member is covered with the elastic layer, making it unnecessary to give the end mold used for the charging member production an internal contour with a stepped portion matching the charging member configuration. As a result, the end mold can be produced precisely and inexpensively. Further, the provision of the stepped portion prevents the elastic layer from displacing itself in the longitudinal direction. As a result, even after the surface of the photosensitive drum 1 is shaved on the region corresponding to the end portion of the charging member, the region associated with image defects is prevented from entering the image forming region.

Referring to FIG. 1, a reference numeral 1 designates a rotary photosensitive drum as the member to be charged, the charge polarity of which is either negative or positive. A reference numeral 2 designates a charge roller as a contact type charging member. The charge roller 2 comprises a metallic core 21, an elastic layer 22, and a surface layer 23. The metallic core 21 is a supporting member, and is formed of stainless steel or the like. The elastic layer 22 is formed of elastic material, and is coaxially formed, in the shape of a roller, on the peripheral surface of the metallic core 21. The surface layer 23 is a resistive layer which covers the peripheral surface of the elastic layer 22. Further, the metallic core 21 is provided with at least one stepped portion 28 in the longitudinal direction. It is preferable that the stepped portion 28 is disposed near the longitudinal end of the metallic core. When the stepped portion 28 is structured in such a manner that the diameter of the metallic core 21 is smaller at the longitudinal end portion than at the longitudinal center portion, the strength of the metallic core 21 can be preserved in spite of the provision of the stepped portion 28, and also, the smaller diameter at the longitudinal end portion allows the downsizing of the metallic core bearing 24 or the like, contributing to reducing the dimension of the image forming apparatus in the longitudinal direction of the charging member.

The elastic layer 22 is formed of ethylenepropylene rubber, ethylene-propylene-diene rubber, butyl rubber, butadiene rubber, silicone rubber, polynorbornen, or the like, in which carbon, titanium oxide, tin oxide, or the like is dispersed. As for the material for the surface layer 23, that is, the resistive layer, there are vinylidene fluoride rubber, tetrafluoroethylene-propylene rubber, epichlorohydrin rubber, urethane rubber, and the like rubbers, in which carbon, tin oxide, or the like is dispersed, and fluorinated resin or the like, in which carbon, tin oxide, or the like is dispersed. Incidentally, one or more functional layers, for example, an electrically conductive layer for rendering the voltage applied to the charging member, uniform in the longitudinal direction, may be disposed between the elastic layer 22 and the surface layer 23.

The specifications of the charge roller in this embodiment are as follows.

The metallic core 21 is a round stainless steel rod with one stepped portion 28. The length is approximately 340 mm, and the diameter is approximately 8 mm at the longitudinal center portion, and approximately 6 mm at the longitudinal end portion. The elastic layer 22 is formed of electrically conductive solid EPDM rubber in which carbon is dispersed. The volumetric resistance value is $10^5$ Ω·cm; the thickness is 2.8 mm; and the length is 326 mm. The unillustrated electrically conductive layer is formed of EPDM or urethane in which a large amount of the particles of electrically conductive material such as carbon, or tin oxides are dispersed. The volumetric resistance value is $10^6$ Ω·cm, and the thickness is 80 μm. The surface layer 23, the resistive layer, is formed of epihydrin rubber. The volumetric resistance value is $10^9$ Ω·cm, and the thickness is 80 μm. The resistive layer 23 is preferred to have a volumetric resistance value larger than those of the elastic layer 22 and the electrically conductive layer.

Figure 12:
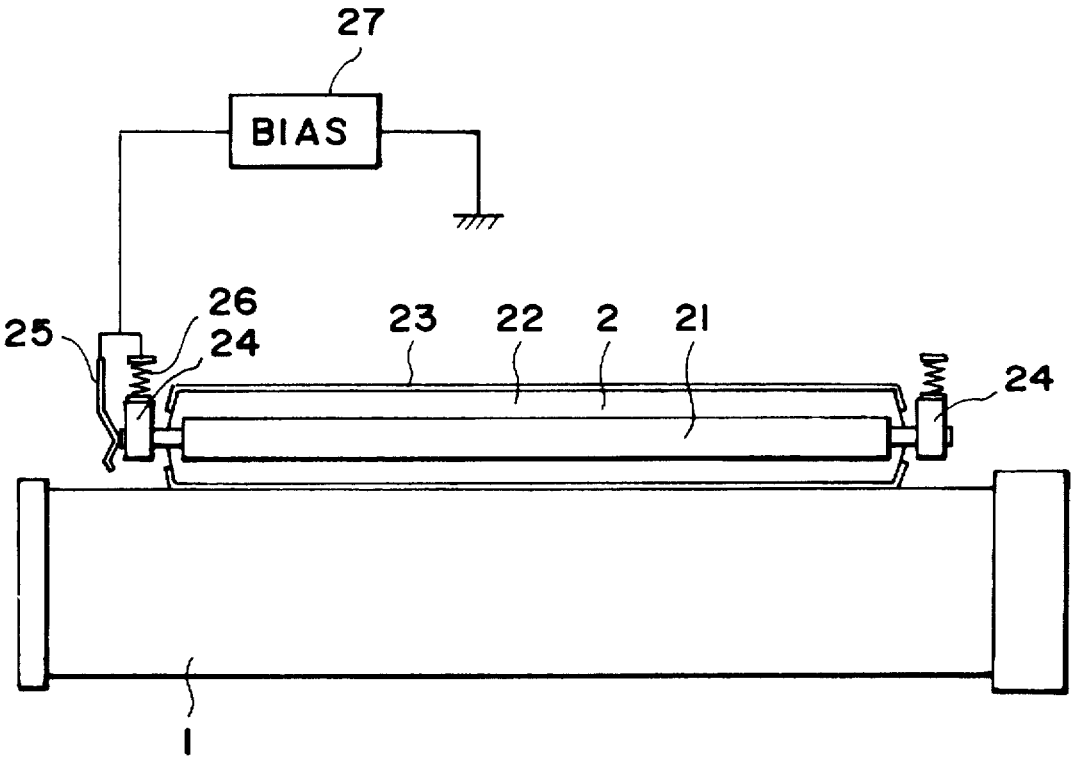
FIG. 12 is a front view of a charging mechanism employing the charging member in accordance with the present invention.

Referring to FIG. 12, the charge roller 2 was supported with bearing members 24, at both longitudinal ends, in the same manner as the conventional charge roller and was placed in contact with the surface of the photosensitive drum 1, with a predetermined contact pressure applied in the direction of the photosensitive drum 1 by a compression spring 26. In this embodiment, the overall contact pressure was 13.72N. The charge roller 2 rotated following the rotation of the photosensitive drum 1. To this charge roller 2, an oscillating voltage (Vac+Vdc) composed by superposing an AC voltage (2.0 kvpp, 350 Hz), on a DC voltage equivalent to a target potential, 700 V, for example, was applied from a bias power source 27 through a sliding electrode 25 placed in contact with the metallic core 21. With this arrangement, that is, a contact type AC application system arrangement, the surface of the photosensitive drum 1 was uniformly charged to a target charge potential. The charge roller used for comparison had the same metallic core and laminar structure as the charge roller of this embodiment, except that the stepped portion of the metallic core 21 was not covered with the elastic roller. The length of the elastic layer of the comparative charger roller was approximately 321 mm.

Figure 2:
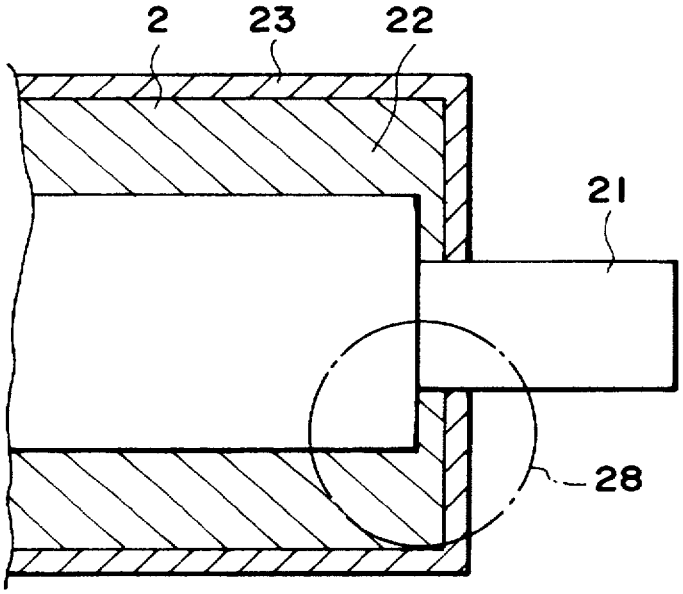
FIG. 2 is a sectional view of the charging member in the second embodiment of the present invention, as seen from the lateral side thereof relative to the longitudinal direction.

When producing the end mold for the charge roller, the conventional type charge roller, the stepped portion of which is not covered with the elastic layer, requires the end mold to be precisely formed to match the stepped portion 28, whereas in the charge roller 2 of this embodiment illustrated in FIG. 2, the stepped portion 28 of the metallic core 21 is covered with the elastic layer 22, and therefore, does not require the end mold to be formed to match the stepped portion 28. Therefore, compared with the charge roller based on the conventional structure, the charge roller in accordance with the present invention makes it possible to reduce the production cost for the end mold.

Further, in comparison with the conventional charge roller, the shifting of the elastic layer of the charge roller of this embodiment is extremely small. Therefore, it is possible to reduce the possibility that when the shaving of the photosensitive drum surface occurs, on the region corresponding to the end portion of the charge roller 2, the region responsible for image defects enters the image forming region.

Embodiment 2

FIG. 2 illustrates the charging member in the second embodiment. In this embodiment, the charge roller 2 is presupposed to be in accordance with the first embodiment, and further, the surface layer 23 as the resistive layer covers the charge roller 2, not only on the peripheral surface, but also, on the longitudinal end surface. Therefore, the electric discharge from the longitudinal end surface of the charge member is suppressed, preventing the photosensitive drum 1 from being shaved by the electric discharge, on the region corresponding to the end portion of the charge roller. As a result, the occurrence of the image defects and the backward buckling of the cleaning blade 10, which are related to the shaving of the photosensitive drum 1, can be prevented.

Figure 11:
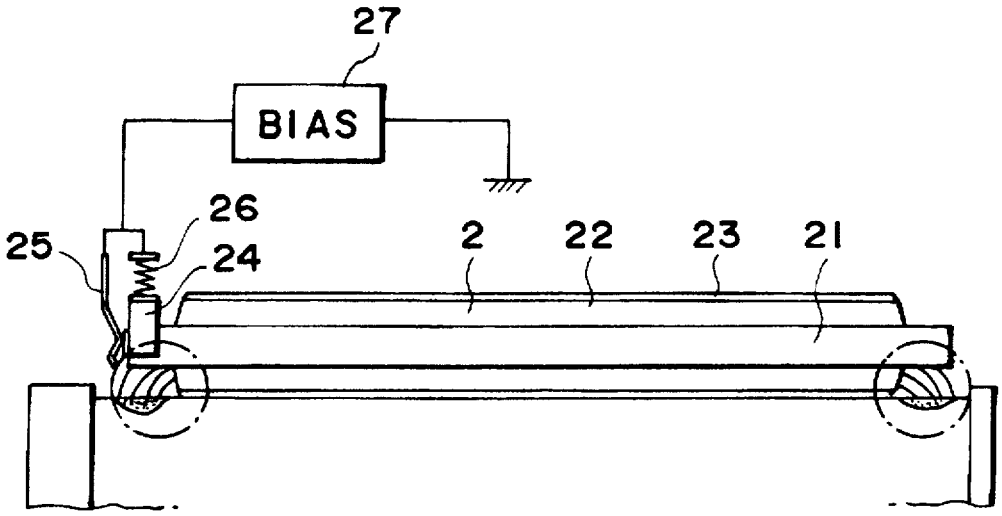
FIG. 11 is a front view of a charge roller and a photosensitive drum, depicting the electrical leakage from the charge roller end to the photosensitive drum.

In this embodiment, the charge roller 2 is similar to that of the first embodiment, but the longitudinal end surface of the charge roller 2 is covered with the surface layer 23 as the resistive layer. In comparison, in the case that the longitudinal end surface of the conventional charge roller is not covered with the surface layer as the resistive layer, electric discharge occurs from the longitudinal end of the charge roller as illustrated in FIG. 11. As a result, the surface layer of the photosensitive drum 1 is shaved by the electric discharge, causing the image defects, or the backward buckling of the cleaning blade 10. Basically, the charge roller 2 in this embodiment is the same as that of the first embodiment, except that the charge roller in this embodiment is covered with the surface layer 23 as the resistive layer, even on the longitudinal end surface.

Figure 14:
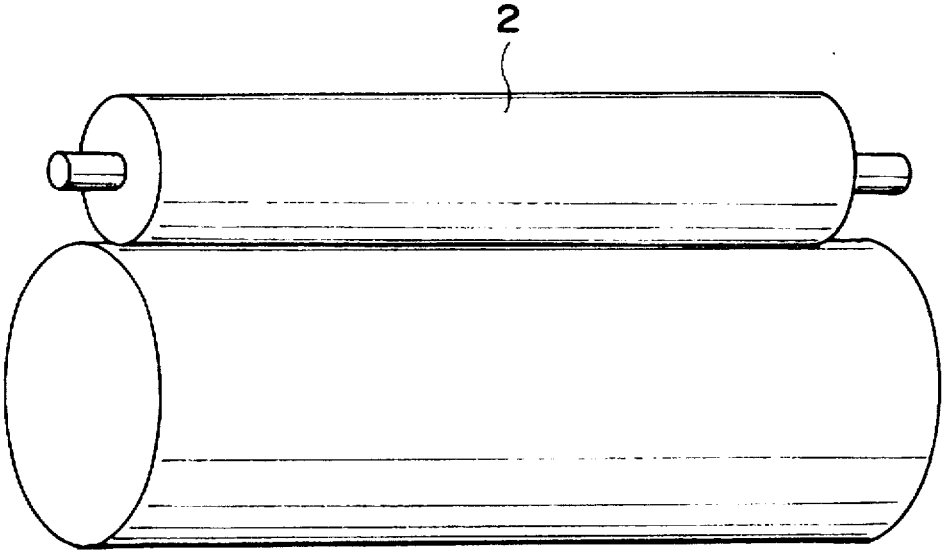
FIG. 14 is a schematic perspective view of an apparatus for observing the electric discharge from the end portion of a charging roller.

Whether or not electric discharge is occurring from the longitudinal end surface of the charge roller 2 can be confirmed by placing the charge roller 2 in contact with a metallic drum as shown in FIG. 14, and applying voltage to the charge roller 2 being rotated by the contact. When there is leakage, the electric discharge from the longitudinal end surface of the charge roller 2 can be observed in a dark ambience. When such electric discharge occurs, the photosensitive drum 1 is extraordinarily attacked by the electric discharge, on the region corresponding to the longitudinal end portion of the charge roller 2. Consequently, the surface shaving of the photosensitive drum 1 becomes abnormal, on the region corresponding to the end portion of the charge roller 2. The abnormally shaved surface of the photosensitive drum 1 causes image defects, or the backward buckling of the cleaning blade 10.

In this embodiment, the longitudinal end surface of the charge roller 2 is covered with the resistive layer; therefore, there is an improvement in terms of the problem related to the electrical leakage from the longitudinal end surface of the charging roller 2. When actual observations were made of the charger roller 2, the surface layer 23, as the resistive layer, which covered the longitudinal end surface of the charge roller 2 to a height of approximately no less than 2 mm from the surface of the photosensitive drum 1, there was no electric discharge from the end portion of the charge roller 2, proving that when the charge roller 2 in accordance with this embodiment is employed, the attack made on the photosensitive drum 1 by electric discharge can be reduced so that the photosensitive drum 1 be shaved by a significantly smaller amount.

Embodiment 3

Figure 3:
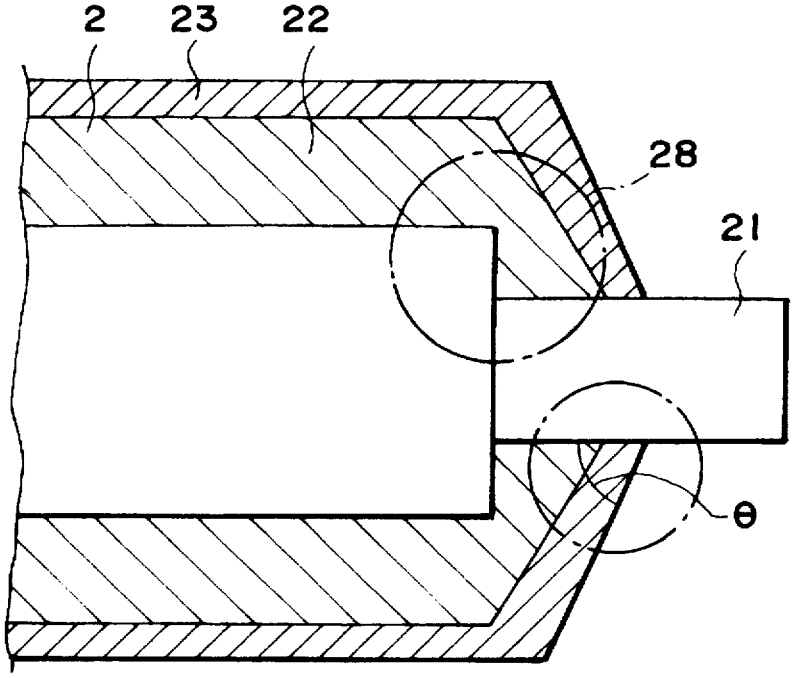
FIG. 3 is a sectional view of the charging member in the third embodiment of the present invention, as seen from the lateral side thereof relative to the longitudinal direction.

FIG. 3 is a schematic section of the charging member in the third embodiment of the present invention. In this embodiment, the charge roller 2 is presupposed to be in accordance with the first and second embodiments, and further, the longitudinal end of the charger roller 2 is tapered at an angle no more than 90° relative to the metallic core 21. This tapering arrangement prevents the longitudinal end portion of the charger roller 2 from becoming harder than the rest, while providing the longitudinal end surface of the charge roller 2 with the surface layer 23 to prevent the end portion of the photosensitive drum 1 from being shaved.

Figure 13:
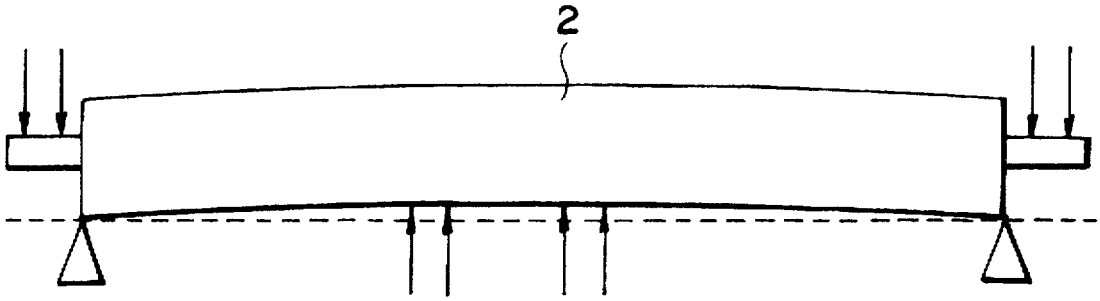
FIG. 13 is a front view of the charge roller, the center portion of which has deformed upward since the end portion of the charge roller is harder than the center portion.
Figure 15:
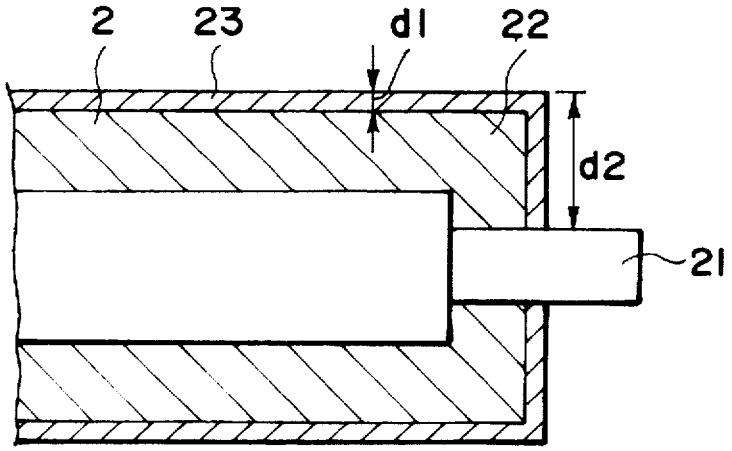
FIG. 15 is a front view of the longitudinal end portion of a charge roller, depicting the relationship between the hardness of the charge roller and the configuration of the end portion thereof.

Referring to FIG. 15, when the resistive layer as the surface layer 23 is extended to cover the entire longitudinal end surface of the charge roller 2, the fact that the hardness of the charge roller 2 is affected by the thickness of the surface layer 23 is taken into consideration. More specifically, the hardness of the center portion of the charge roller 2 is affected by a thickness dl of the surface layer 23, whereas the hardness of the longitudinal end portion is affected by a thickness of d2 of the surface layer 23, which is more than dl. Therefore, when the hardness of the surface layer 23 is substantially more than that of the underlayer, the longitudinal end portion of the charge roller 2 becomes harder than the rest. When the charge roller 2 having the end portions harder than the rest is pressed upon the photosensitive drum 1 by applying pressure to the end portions of the metallic core 21 as shown in FIG. 13, the center portion of the charge roller 2 does not remain in contact with the photosensitive drum 1; and the center portion slightly floats away from the surface of the photosensitive drum 1, with the end portions remaining anchored to the photosensitive drum 1. The floating portion induces electric discharge which attacks the photosensitive drum 1, and therefore, the photosensitive drum 1 is shaved more on the portion corresponding to the floating portion of the charge roller 2 than on the rest. Consequently, the portion of the photosensitive drum 1 corresponding to the floating portion of the charge roller 2 is liable to effect more image defects than the rest.

The following should be noted here. In order to keep the charger roller 2 and the photosensitive drum 1 perfectly in contact with each other, and also in order to suppress the charge noise generated by the AC voltage applied to the charge roller 2, sponge is preferred as the material for the elastic layer 22. Further, the surface layer 23 is preferred to have a higher degree of slipperiness. When both of the above preferences are satisfied, the hardness of the surface layer 23 in ASKAR-C scale becomes higher than that of the elastic layer 22.

Further, when the center portion of the charge roller floats from the photosensitive drum 1, the post-transfer residual toner eludes the cleaning blade 10, and the particles which are generated when the surface layer of the photosensitive drum 1 is shaved by the attack made on the photosensitive drum 1 by electric discharge are liable to adhere to the floating portion. As the residual toner and the above particles accumulate on the center portion of the charge roller 2, the resistance of the center portion of the charge roller 2 becomes higher than the rest. As a result, the photosensitive drum 1 is liable to be insufficiently charged, on the center portion.

Figure 16:
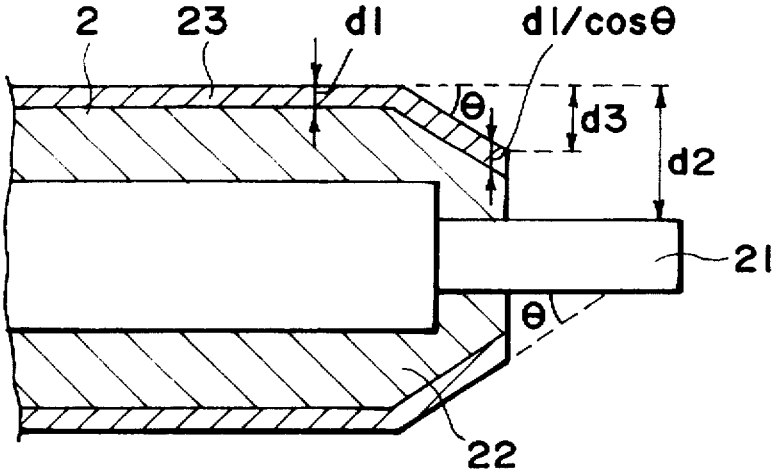
FIG. 16 is a front view of the longitudinal end portion of a charge roller, also depicting the relationship between the hardness of the charge roller and the configuration of the end portion.

In the case of the charge roller 2 of this embodiment, since the end portion of the charge roller 2 is tapered at an angle of no more than 90° relative to the metallic core, the effects of surface layer 23 in terms of increasing the hardness of the end portion of the charge roller 2 more than that of the rest are relatively small even when the surface layer 23 is extended to cover the longitudinal end surface of the charge roller 2. Therefore, the floating of the center portion of the charge roller 2 can be prevented. More specifically, referring to FIG. 15, when the end surface of the charge roller 2 holds an angle of 90° relative to the metallic core 21, the thickness of the surface layer 23, which is directly related to the hardness of the charge roller 2, is d2 at the end portion, whereas it is only dl across the center portion. On the other hand, when the end portion of the charge roller 2 is tapered at an angle of $\theta$ ($\theta<90°$) as shown in FIG. 16, the effects of the surface layer 23 in terms of the hardness of the charge roller 2, at the end portion, is reduced to $d1/\cos\theta$. The value of $d1/\cos\theta$ can be reduced to be far smaller than the value of d2, by reducing the value of $\theta$.

Basically, the base member and the surface layer 23 of the charge roller 2 in this embodiment are the same as those described in the first and second embodiment, except for a small modification. That is, in this embodiment, the charge roller 2 is tapered at the longitudinal end, at an angle of no more than 90° relative to the metallic core 21. As the value of $d/\cos\theta$becomes smaller, the hardness of the end portion increases less. However, when $\theta$ becomes too small, the non-imaging region of the charge roller 2 becomes too long, requiring the length of the charge roller 2 to be increased. Further, d3 is not allowed to be sufficiently large, and therefore, electric discharge is liable to occur from the end surface of the charge roller 2. Thus, the value of $\theta$ is preferred to be in a range of 10°–50°, more preferably, 15°–30°. With the provision of the above arrangement, the electric discharge from the end surface of the charge roller 2 can be prevented, and also, the center portion of the charge roller 2 can be prevented from floating.

Embodiment 4

Figure 4:
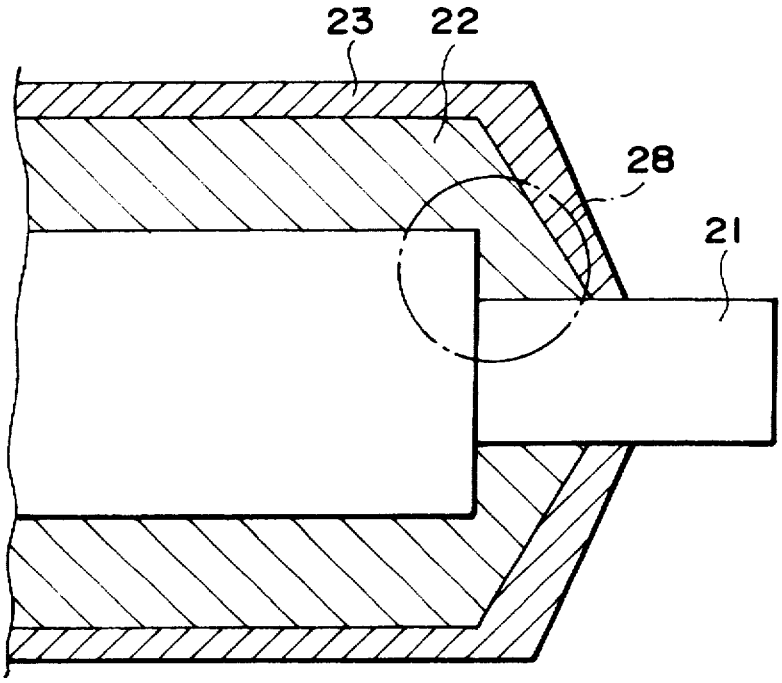
FIG. 4 is a sectional view of the charging member in the fourth embodiment of the present invention, as seen from the lateral side thereof relative to the longitudinal direction.

FIG. 4 is a schematic section of the charging member in the fourth embodiment of the present invention. This embodiment, which is inclusive of the first to third embodiments, is characterized in that even when material with less hardness, such as foamed material, is employed as the material for the elastic layer in order to suppress the charging noise which occurs due to the vibration of the charging member and the photosensitive drum 1 when an AC voltage is applied to the charging member, an appropriate distance is kept between the metallic core 21 and the surface of the photosensitive drum 1, so that the attack on the photosensitive drum 1 by the electric discharge from the metallic core 21 of the charge roller 2 can be suppressed to prevent the shaving of the surface of the photosensitive drum 1.

As for the material for the elastic layer in this embodiment, foamable material such as polystyrene, polyolefin, polyurethane, polyamide, or EPDM, is employed. The volumetric resistivities of these materials are reduced by dispersing electrically conductive material such as carbon or tin oxide in the foamable material.

Figure 5:
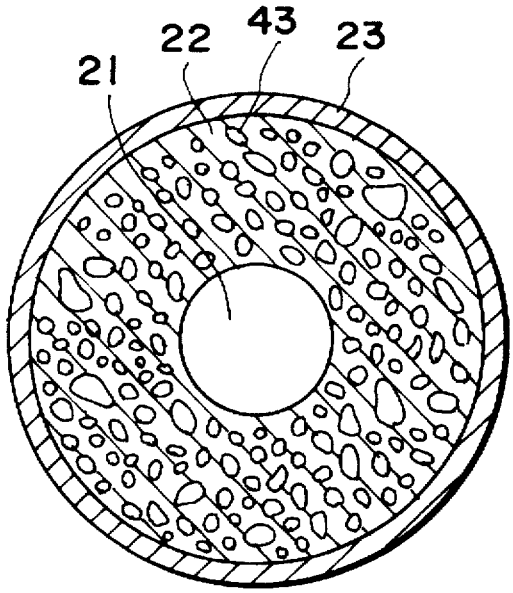
FIG. 5 is a sectional view of the charging member in the fourth embodiment of the present invention, as seen from the longitudinal direction thereof.
Figure 6:
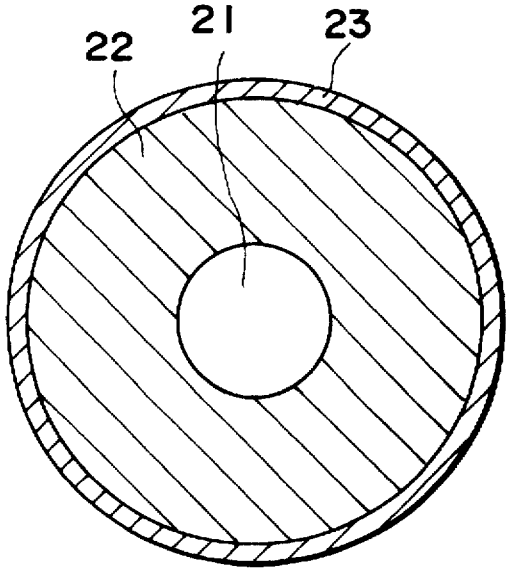
FIG. 6 is a sectional view of a conventional charging member as seen from the longitudinal direction thereof.
Figure 7:
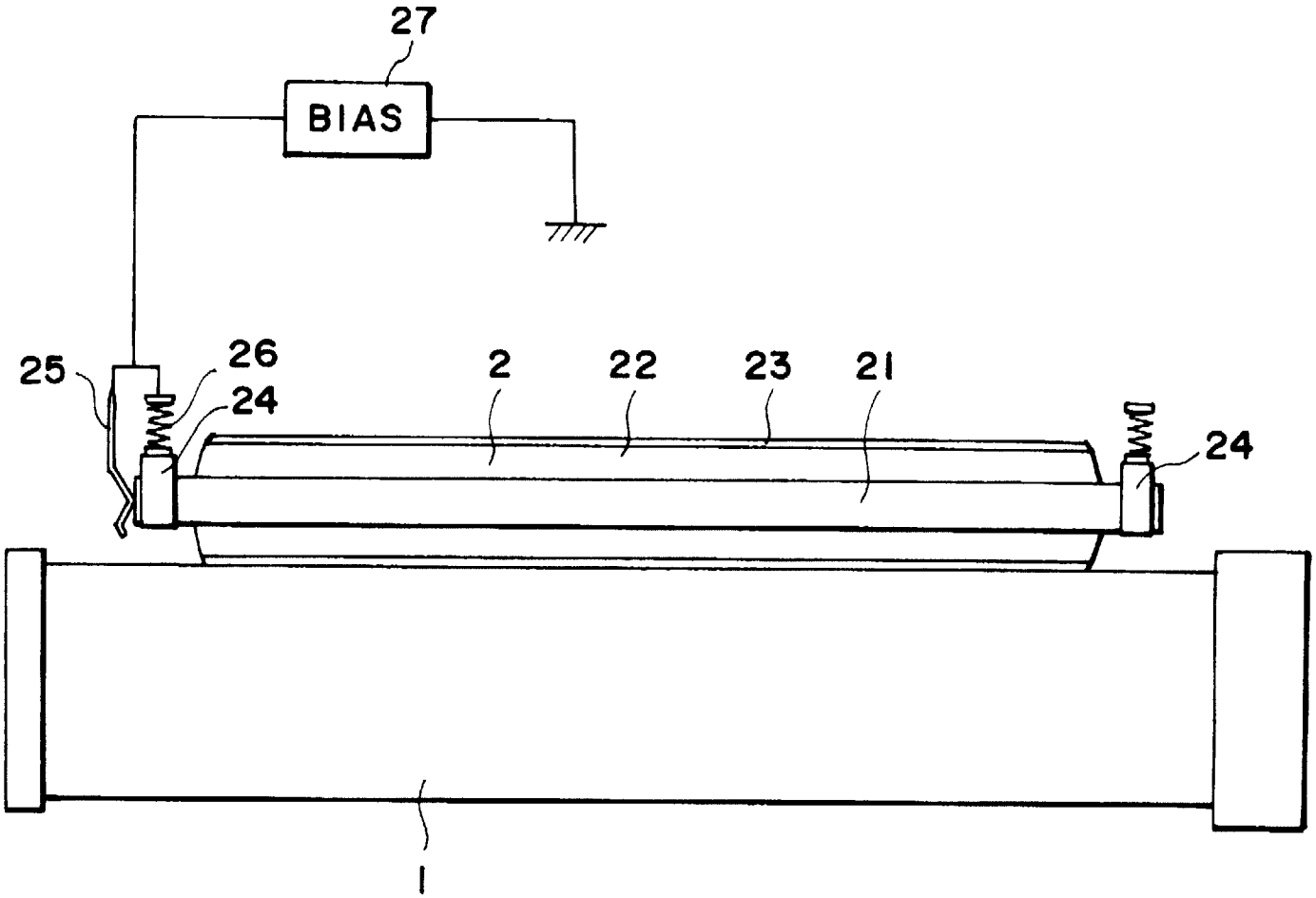
FIG. 7 is a schematic front view of a charging mechanism employing the conventional charging member.
Figure 8:
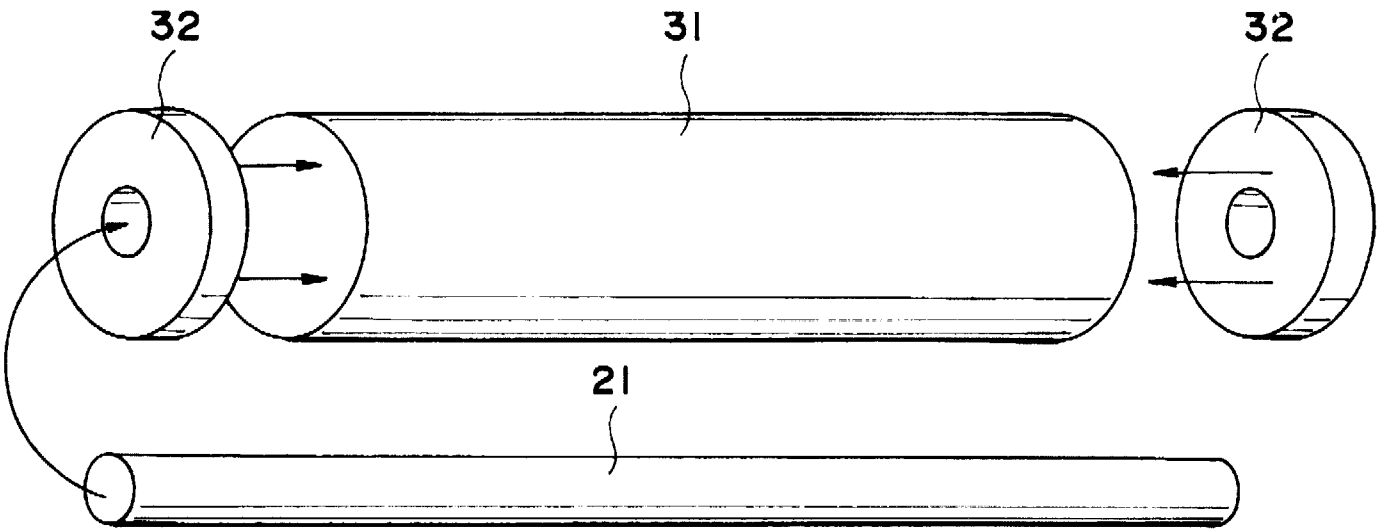
FIG. 8 is a schematic conceptual drawing depicting a method for producing a charging roller.
Figure 9:
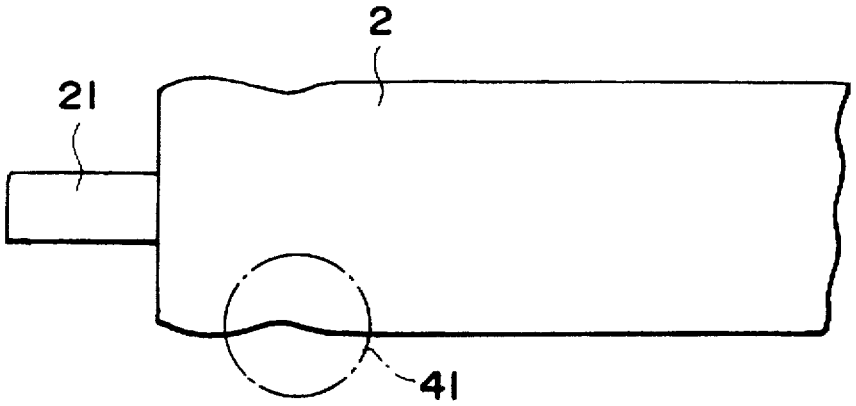
FIG. 9 is a front view of the longitudinal end portion of the charging member.
Figure 10:
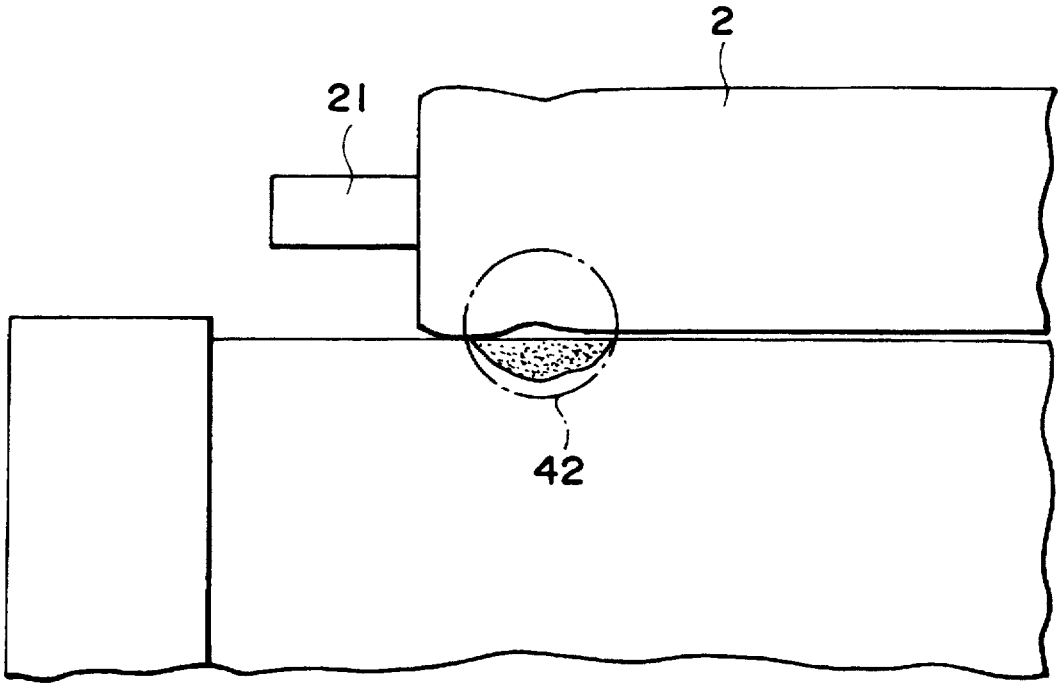
FIG. 10 is a front view of the longitudinal end portions of a charge roller and a photosensitive drum, depicting the electric discharge caused by the deformation of the end portion of the charge roller.

Referring to FIG. 5, in this embodiment, since foamed material is employed as the material for the elastic layer 22 of the charge roller 2, the elastic layer 22 contains a large number of bubbles 43, which renders the elastic layer 22 in this embodiment far softer than the elastic layer of solid rubber in the conventional charge roller illustrated in FIG. 6.

When the elastic layer 22 is softened by using the soft foamed material as the material for the elastic layer 22, the vibration of the charge roller 2 and the photosensitive drum 1, which is caused by the application of oscillating voltage to the charge roller 2, is reduced by absorption. Therefore, the charging noise which is generated when the charge roller 2 and the photosensitive drum 1 are vibrated by the oscillating voltage can be prevented. However, since these materials are extremely soft, the elastic layer 22 of the charge roller 2 is easily deformed by the contact pressure as the charge roller 2 is pressed on the photosensitive drum 1.

As the elastic layer 22 is deformed by the contact pressure, the distance between the end portion of the metallic core 21, where the metallic material is exposed, and the surface of the photosensitive drum 1 is reduced, which increases the possibility that electric discharge occurs from the end portion of the metallic core 21 to the photosensitive drum 1. However, in this embodiment, the configuration of the metallic core is such that the diameter of the end portion is smaller than the center portion, and also, the stepped portion 28 of the metallic core 21 is covered with the elastic layer 22; therefore, the distance between the end portion of the metallic core 21 and the surface of the photosensitive drum 1 is larger than that of the charge roller whose metallic core has a uniform diameter across its entire length. As a result, the occurrence of the electric discharge from the end portion of the metallic core 21 to the photosensitive drum 1 can be prevented.

Embodiment 5

Figure 18:
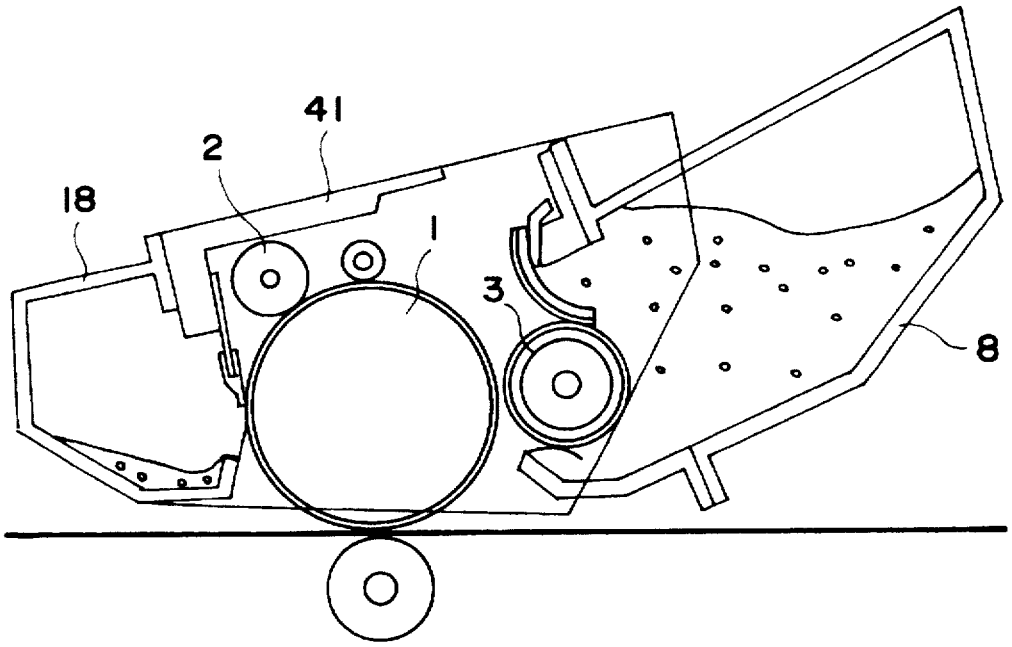
FIG. 18 is a schematic section of the process cartridge in the fifth embodiment of the present invention.

FIG. 18 depicts the fifth embodiment of the present invention. This embodiment is characterized in that the process cartridge of this embodiment comprises the charge roller 2, as the charging member, described in the first to fourth embodiments, and at least one photosensitive drum as an image bearing member, wherein the charge roller 2 and the photosensitive drum are integrally disposed in a cartridge shell, so that the process cartridge can be removably installed in the main assembly of an image forming apparatus, which comprises a means for removably accommodating the process cartridge.

Referring to FIG. 18, a reference numeral 1 designates a photosensitive rotary drum, as a member to be charged, chargeable to either positive or negative polarity. A reference numeral 2 designates a charge roller as the contact type charging member. This charge roller 2 is one of the charge rollers among those described in the first to fifth embodiments.

The process cartridge 41 in this embodiment comprises a cartridge shell in which the photosensitive drum 1, the charging member 2, the developing apparatus 8, and the cleaning apparatus 18 are integrally disposed, and means (unillustrated) which renders the process cartridge 41 removably installable in the main assembly of an image forming apparatus.

The process cartridge 41 is mechanically and electrically connected to an image forming apparatus as it is installed in the image forming apparatus. The photosensitive drum 1 is driven by the motor provided in the main assembly of the image forming apparatus. The charging apparatus, and the developing apparatus, are supplied with bias voltage by the main assembly of the image forming apparatus, through electrical contact points.

Such connection between the process cartridge and the main assembly of the image forming apparatus makes the image forming apparatus ready for image formation, that is, enables the image forming apparatus to output recorded images through the normal image forming process.

As for the aforementioned stepped portion, two or more may be disposed adjacent to the longitudinal end portion of the charge roller. Further, it is preferable that the stepped portion be disposed closer to the longitudinal end of the charging member than at the center portion or adjacent thereto. More specifically, the stepped portion is preferred to be disposed outside the maximum image formation range of the photosensitive drum, in the longitudinal direction of the charging member.

While the invention has been described with reference to the structures disclosed herein, it is not confined to the details set forth, and this application is intended to cover such modifications or changes as may come within the purposes of the improvements or the scope of the following claims.

What is claimed is:

1. A charging member contactable to a member to be charged and capable of being supplied with a voltage to charge the member to be charged, said charging member comprising:

a core member having a stepped portion to provide a smaller diameter portion at an end portion side thereof than at a longitudinally central side thereof, wherein said stepped portion has a flat surface that is substantially perpendicular to a longitudinal direction of said charging member; and an elastic member supported by said core member, said elastic member covering said stepped portion.

2. A charging member according to claim 1, further comprising a surface resistance layer having a volume resistivity that is larger than a volume resistivity of said elastic member, wherein said resistance layer is provided on a longitudinal end surface of said charging member.

3. A charging member according to claim 2, wherein said resistance layer is provided with a tapered portion extending in a direction crossing with the longitudinal direction of said charging member from a longitudinally central portion thereof toward a longitudinal end portion adjacent the longitudinal end surface of said charging member.

4. A charging member according to claim 1, wherein said elastic member is made of a foamed material.

5. A charging member according to any one of claims 1–4, wherein said stepped portion is provided adjacent the end portion.

6. A charging member according to claim 5, wherein said charging member is in the form of a roller.

7. A charging member according to any one of claims 1–4, wherein said charging member is in the form of a roller.

8. A charging member according to claim 1, further comprising a surface resistance layer having a volume resistivity that is larger than a volume resistivity of said elastic member, wherein an end of said resistance layer is outside a maximum image area of said member to be charged in the longitudinal direction of said charging member.

9. A process cartridge detachably mountable relative to a main assembly of an image forming apparatus, said process cartridge comprising:

an image bearing member for bearing an image; and a charging member contactable to a member to be charged and capable of being supplied with a voltage to charge the member to be charged, said charging member including a core member having a stepped portion to provide a smaller diameter portion at an end portion side thereof than at a longitudinally central side thereof, wherein said stepped portion has a flat surface that is substantially perpendicular to a longitudinal direction of said charging member; and an elastic member supported by said core member, said elastic member covering said stepped portion.

10. A process cartridge according to claim 9, further comprising a surface resistance layer having a volume resistivity that is larger than a volume resistivity of said elastic member, wherein said resistance layer is provided on a longitudinal end surface of said charging member.

11. A process cartridge according to claim 10, wherein said resistance layer is provided with a tapered portion extending in a direction crossing with the longitudinal direction of said charging member from a longitudinally central portion thereof toward a longitudinal end portion adjacent the longitudinal end surface of said charging member.

12. A process cartridge according to claim 10, wherein said elastic member is made of a foamed material.

13. A process cartridge according to any one of claims 9–12, wherein said stepped portion is provided adjacent the end portion.

14. A process cartridge according to claim 13, wherein said charging member is in the form of a roller.

15. A process cartridge according to any one of claims 9–12, wherein said charging member is in the form of a roller.

16. A process cartridge according to claim 9, wherein said stepped portion is outside a maximum image area of said image bearing member in the longitudinal direction of said charging member.

17. A process cartridge according to claim 9, further comprising a surface resistance layer having a volume resistivity that is larger than a volume resistivity of said elastic member, wherein an end of said resistance layer is outside a maximum image area of said image bearing member in the longitudinal direction of said charging member.

* * * * *

UNITED STATES PATENT AND TRADEMARK OFFICE

CERTIFICATE OF CORRECTION

PATENT NO. : 5,790,927

DATED : August 4, 1998

INVENTOR(S) : ATSUTOSHI ANDO ET AL.

It is certified that error appears in the above-identified patent and that said Letters Patent is hereby corrected as shown below:

COLUMN 2

Line 28, "charger" should read --charge--.

COLUMN 3

Line 6, "1," should read --1--.

COLUMN 4

Line 17, "charged," should read --charged--.

COLUMN 8

Line 39, "1 be" should read --is--.
Line 46, "charger" should read --charge--.
Line 49, "charger" should read --charge--.

COLUMN 9

Line 14, "charger" should read --charge--.

Signed and Sealed this

Thirtieth Day of March, 1999

*Attest:*

Q. TODD DICKINSON

*Attesting Officer*

*Acting Commissioner of Patents and Trademarks*